US005333699A

United States Patent [19]

Thigpen et al.

[11] Patent Number: 5,333,699

[45] Date of Patent: Aug. 2, 1994

[54] DRILL BIT HAVING POLYCRYSTALLINE DIAMOND COMPACT CUTTER WITH SPHERICAL FIRST END OPPOSITE CUTTING END

[75] Inventors: Gary M. Thigpen, County of Harris; William H. Sherwood, both of County of Harris, Tex.

[73] Assignee: Baroid Technology, Inc., Houston, Tex.

[21] Appl. No.: 995,814

[22] Filed: Dec. 23, 1992

[51] Int. Cl.[5] ..... E21B 10/46

[52] U.S. Cl. ..... 175/431; 175/432

[58] Field of Search ..... 175/431, 432, 430, 428, 175/435

[56] References Cited

U.S. PATENT DOCUMENTS

| | | | |
|---|---|---|---|
| 4,200,159 | 4/1980 | Peschel et al. | 175/432 X |
| 4,593,777 | 6/1986 | Barr | 175/431 X |
| 4,660,659 | 4/1987 | Short, Jr. et al. | 175/431 |
| 4,679,639 | 7/1987 | Barr et al. | 175/432 |
| 4,984,642 | 1/1991 | Renard et al. | 175/430 |
| 4,989,578 | 2/1991 | Lebourg | 175/431 X |
| 5,172,778 | 12/1992 | Tibbitta et al. | 175/431 X |

FOREIGN PATENT DOCUMENTS

| | | | |
|---|---|---|---|
| 2609750 | 7/1988 | France | 175/432 |

OTHER PUBLICATIONS

MEGADIAMOND's advertisement, 4 pages, Oct. 1981.

*Primary Examiner*—Hoang C. Dang

*Attorney, Agent, or Firm*—Browning, Bushman, Anderson & Brookhart.

[57] ABSTRACT

A drag bit having a plurality of blades or ribs on its end face has one or more pockets milled into the top surfaces of said blades using a ball nosed end mill to create a plurality of pockets, each having a spherical or a semi-spherical first end and a second end having a semi-circular configuration which intersects with the leading edge face of the rib. A bullet-shaped cutting structure having a spherical first end is brazed into each of the pockets. During the manufacturing process, a pin is brazed into cooperating first and second semi-circular receptacles in the spherical end of the cutter and in the semi-spherical end of the pocket, respectively, to prevent the cutter assembly from being pushed up out of the pocket during the drilling operation. In an alternative embodiment, a slot is milled into the top surface of the rib to allow use of a ball nosed end mill having a reduced diameter shank sized to pass through the slot. In yet another embodiment, a tungsten carbide button or insert is position at the gauge diameter to reduce impact on the gauge diameter cutter in each of the ribs. Cutter assemblies are disclosed having a variety of orifices in the PDC cutter face to function as chip breakers during the drilling operation.

28 Claims, 8 Drawing Sheets

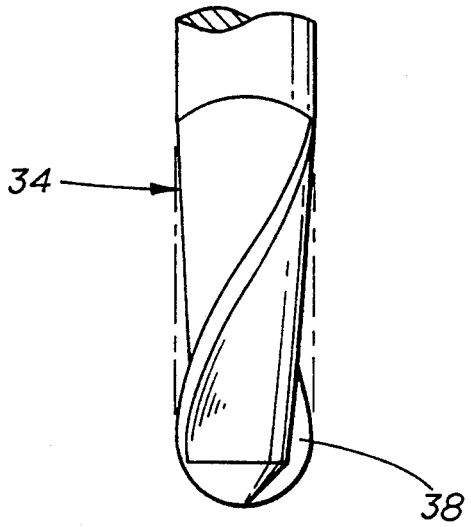
FIG. 11
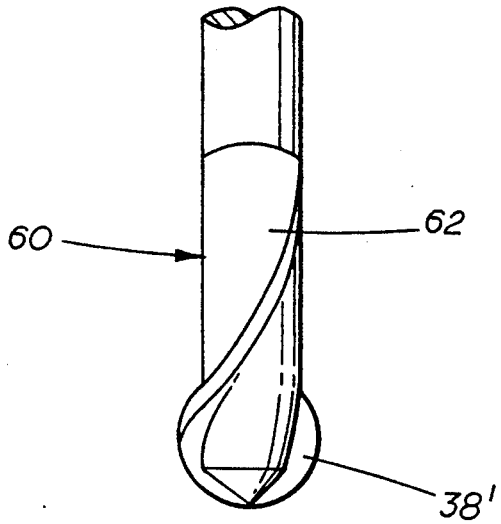
FIG. 12
FIG. 13
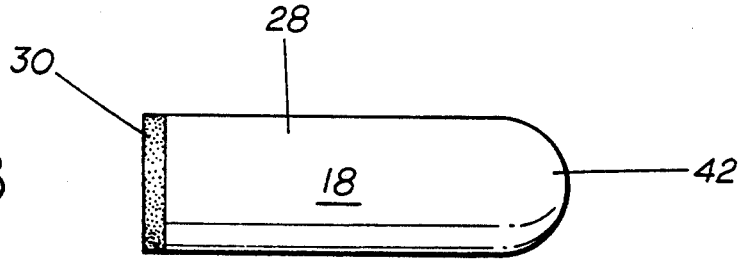
FIG. 14
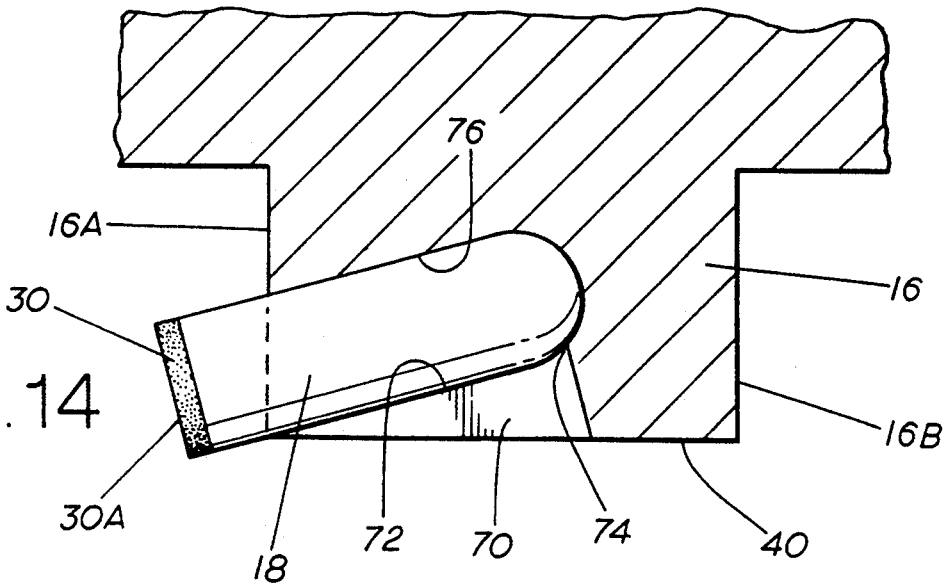

FIG. 30
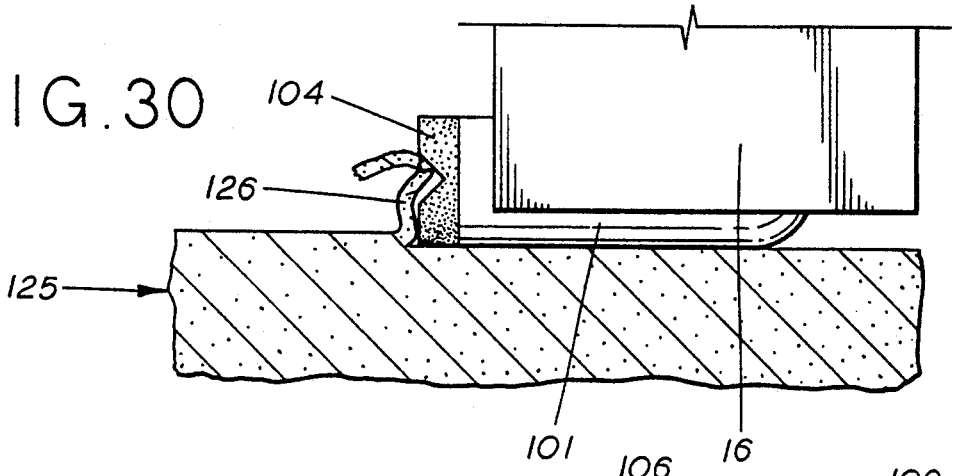
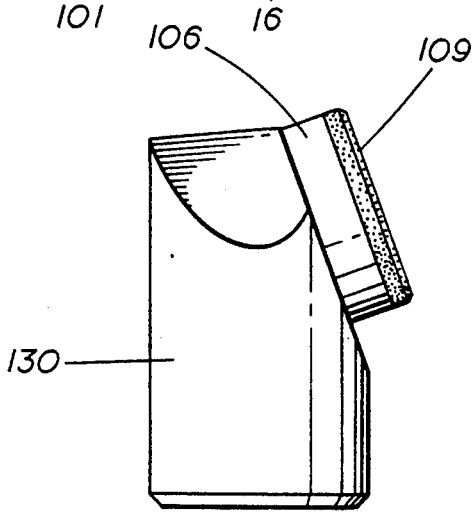
FIG. 31
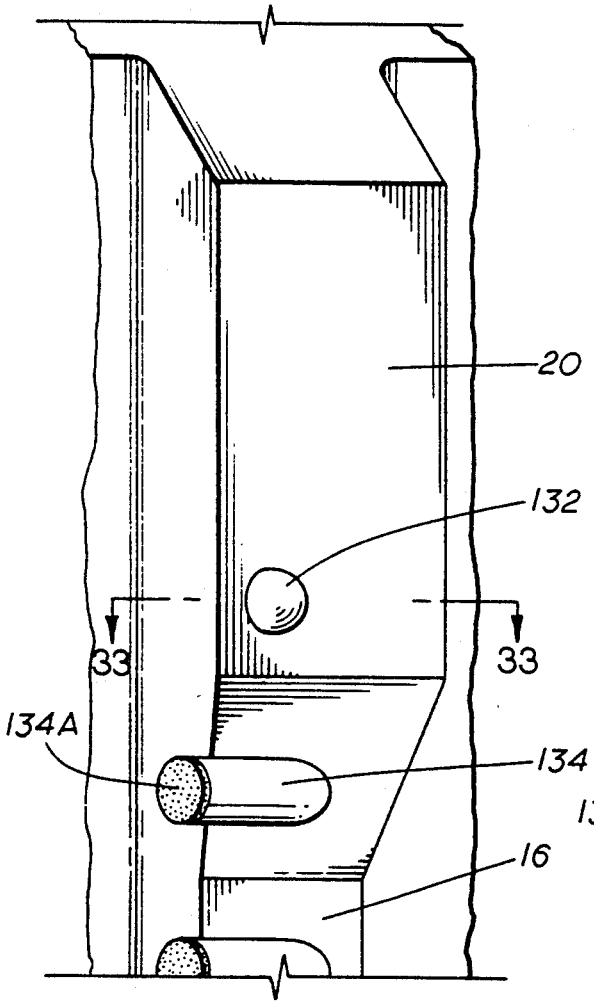
FIG. 32
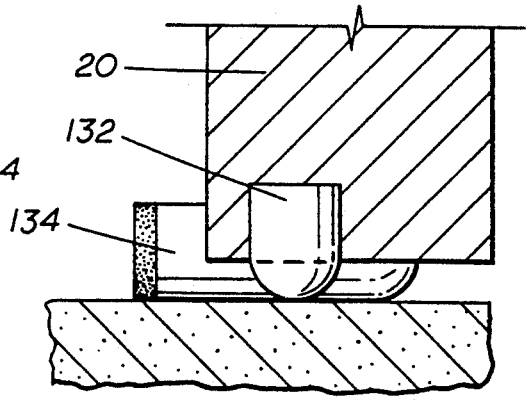
FIG. 33

DRILL BIT HAVING POLYCRYSTALLINE DIAMOND COMPACT CUTTER WITH SPHERICAL FIRST END OPPOSITE CUTTING END

BACKGROUND OF THE INVENTION

The present invention relates, generally, to drill bits used for the drilling of oil and gas wells, and also relates to methods for manufacturing such drill bits. Such bits are used in drilling earth formations in connection with oil and gas exploration and production.

DESCRIPTION OF THE PRIOR ART

It is well known in prior art drill bits to use cutting elements having on one end thereof a polycrystalline diamond compact, generate referred to as a "PDC". The PDC material is typically supplied in the form of a relatively thin layer on one face of a substantially larger mounting body. The mounting body is usually a stud-like end configuration, and typically is formed of a relatively hard material such as sintered tungsten carbide. The diamond layer may be mounted directly on the stud-like mounting body, or it may be mounted via an intermediate disc-like carrier, also typically comprised of sintered tungsten carbide. In any event, the diamond layer is typically disposed at one end of the stud-like mounting body, the other end of which is mounted in a bore or recessed in the body of the drilling bit.

The bit body itself is typically comprised of one of two materials. The body is either a tungsten carbide matrix, or is made of various forms of steel. When the body is made of steel, the pocket for receiving the stud is usually in the shape of a cylinder to receive the cylindrically shaped stud of the cutter.

It has been well known in this art that when the bit body is comprised of a tungsten carbide matrix, the pockets can be formed in whatever shape is desirable. For example, in U.S. Pat. No. 4,200,159 to Eberhard Peschel et al., there is disclosure that the cutter body can be in the form of a cylinder as illustrated in FIG. 7 of that patent or can be in the form of a pin (see FIG. 14) or in the form of a cone as illustrated in FIGS. 15 and 16 of U.S. Pat. No. 4,200,159.

When using a so-called blade cutter, those in the art of steel bodied bits have usually machined the cylindrical pockets from the front of the blade, thereby limiting access to the center of the bit.

We have discovered that by using a PDC cutter having a center cylindrical section and a spherical section on one end away from the PDC cutter end, thus essentially being in the shape of a bullet, the cutter can be placed in a pocket conforming, at least in part, to the spherical end of the cutter. We are thus able to provide cutter locations in the center of the bit that have not been previously available to those in the art.

SUMMARY OF THE INVENTION

The objects of the invention are accomplished, generally, by the provision of a new and improved drag bit for drilling oil and gas wells, comprising:

a hard metal body having an end face, said end face defining a plurality of upsets each having a top surface and a leading edge surface, at least one of said top surfaces having at least one pocket milled therein, said at least one pocket having a semi-spherical first end and a semi-circular second end intersecting said leading edge surface; and a cutting structure brazed into said at least one pocket, said cutting structure having a spherical first end at least partially conforming to the said first end of said pocket and a second end defining a polycrystalline diamond compact cutting face.

Another feature of the invention involves a drag bit comprising:

a hard metal having an end face, said end face defining a plurality of upsets each having a top surface and a leading edge surface, at least one of said surfaces having at least one slot milled therein, said at least one slot having first and second ends, said second end intersecting said leading edge surface, the upset having said at least one slot also having at least one pocket milled therein, said at least one pocket having a spherical first end and a semi-circular second end, said at least one slot being contiguous to said at least one pocket; and a cutting structure brazed into said at least one pocket, said cutting structure having a spherical first end conforming to the said first end of said pocket and a second end defining a polycrystalline diamond cutting face.

The invention is also characterized in that there is provided a cutting structure for a drag bit having a spherical first end and a second end defining a polycrystalline diamond compact cutting surface.

The invention is further characterized as having additional means to anchor the cutting body into a pocket milled into the hard metal bit body.

BRIEF DESCRIPTION OF DRAWINGS

FIG. 11 is a pictorial view of a ball nosed end mill used in the manufacturing process in accord with the present invention;

FIG. 12 is an alternative ball nosed end mill having a reduced shank which is sized to pass through the slot illustrated in FIGS. 7-10;

FIG. 13 is a pictorial view of a bullet-shaped cutter in accord with the present invention;

FIG. 14 is an elevated view of an alternative embodiment of the present invention in which the cutter is brazed into place in a pocket angled away from the top surface of the rib in accord with the present invention;

FIG. 30 is a pictorial, schematic view of the cutter assembly of FIG. 22 in the process of breaking a chip;

FIG. 31 is an elevated view of one of the cutter faces illustrated in FIGS. 24–29 mounted on a conventional stud body;

FIG. 32 is an alternative embodiment of the present invention illustrating the use of a tungsten carbide button or insert on the gauge diameter of the drill bit; and FIG. 33 is an end view of a tungsten carbide button illustrated in FIG. 32.

DETAILED DESCRIPTION OF PREFERRED EMBODIMENT

Figure 1:
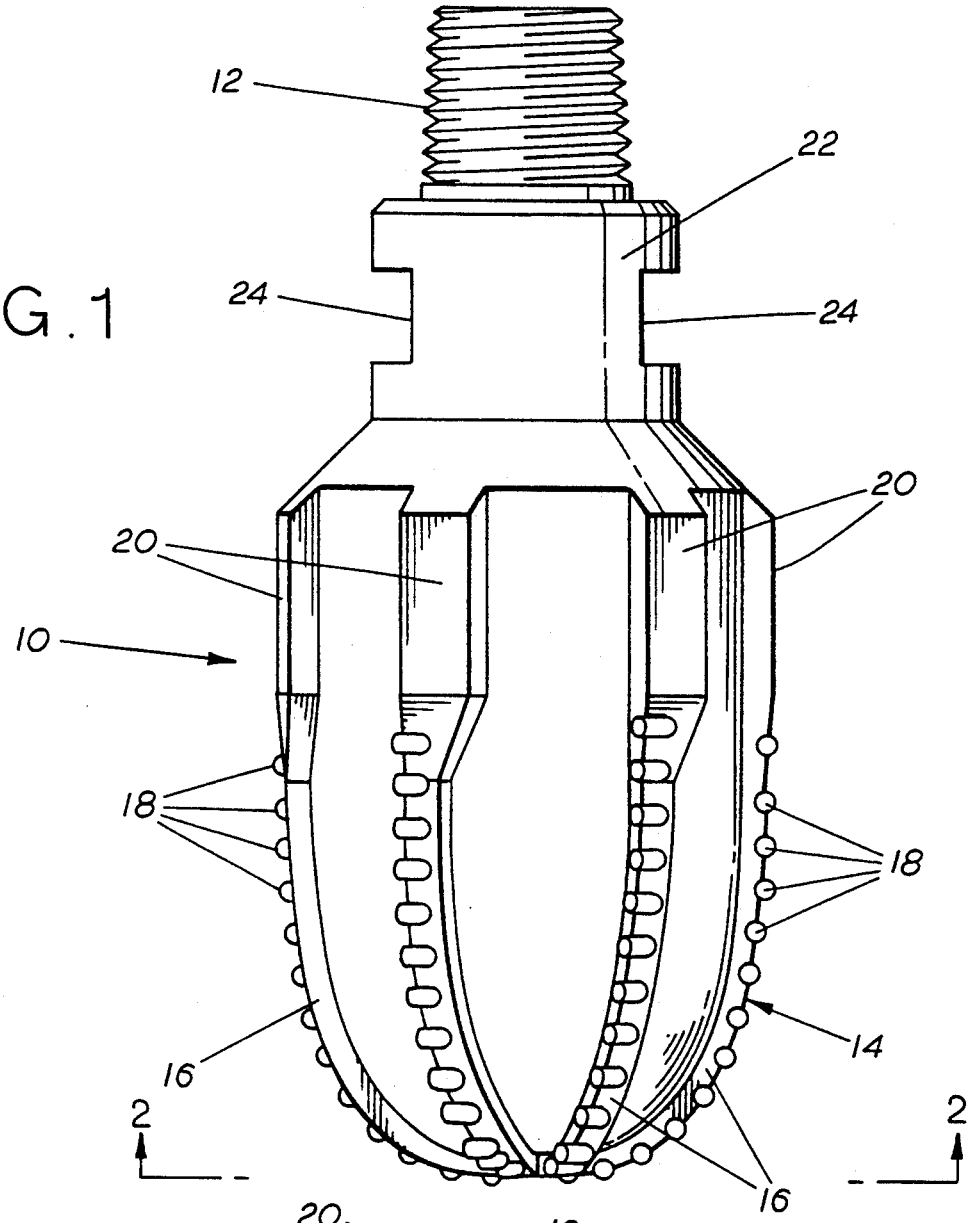
FIG. 1 is an elevated, pictorial view of a drill bit in accordance with the present invention.
Figure 2:
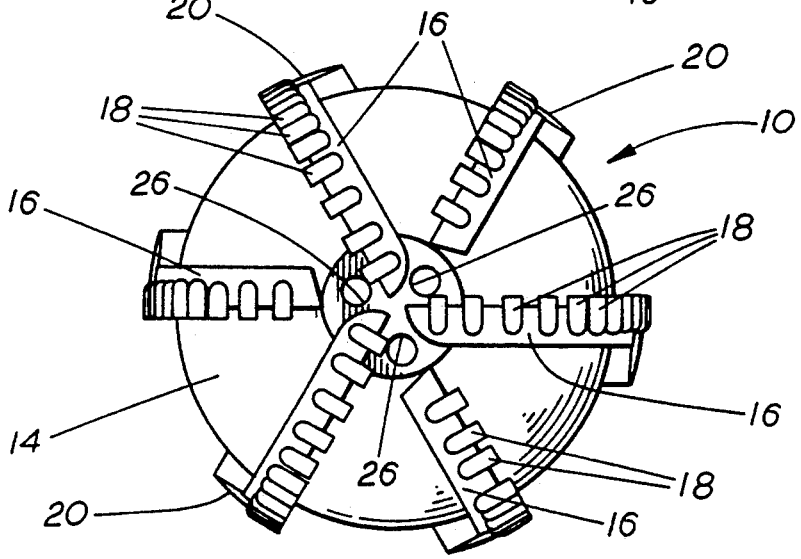
FIG. 2 is an end view of the working face of the drill bit in accordance with FIG. 1.

FIGS. 1 and 2 depict a drill bit of the type in which the present invention may be used. As used herein, "drill bit" will be broadly construed as encompassing both full bore bits and coring bits. Bit body 10, manufactured from steel or another hard metal, has a threaded pin 12 at one end for connection in the drill string, and an operating end face 14 at its opposite end. The "operating end face" as used herein includes not only the axial end or axially facing portion shown in FIG. 2, but contiguous areas extending up along the lower sides of the bit, i.e., the entire lower portion of the bit which carries the operative cutting members described herein below. More specifically, the operating end face 14 of the bit is transversed by a number of upsets in the form of ribs or blades 16 radiating from the lower central area of the bit and extending across the underside and up along the lower side surfaces of the bit. Ribs 16 carry cutting members 18, to be described more fully below. Just above the upper ends of rib 16, bit 10 has a gauge or stabilizer section, including stabilizer ribs or kickers 20, each of which is continuous with a respective one of the cutter carrying rib 16. Ribs 20 contact the walls of the borehole which has been drilled by operating end face 14 to centralize and stabilize the bit and to help control its vibration.

Intermediate the stabilizer section defined by ribs 20 and the pin 12 is a shank 22 having wrench flats 24 which may be engaged to make-up and break-out the bit from the drill string (not illustrated). Referring again to FIG. 2, the under side of the bit body 10 has a number of circulartion ports or nozzles 26 located near its centerline, nozzles 26 communicating with the inset areas between rib 16, which areas serve as fluid flow spaces in use.

Figure 3:
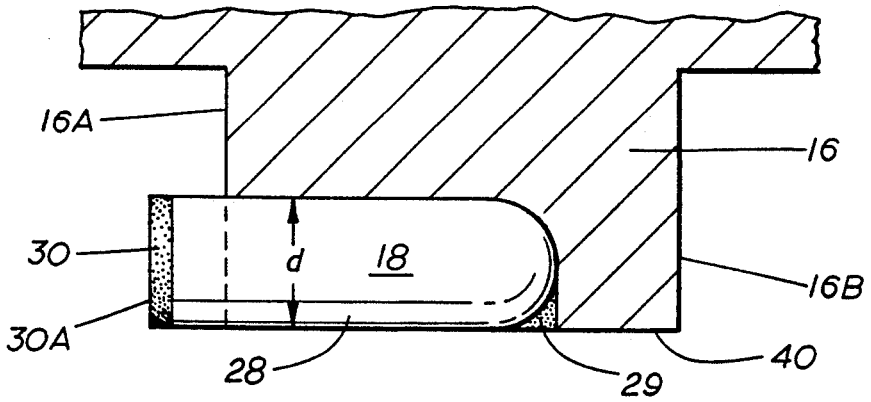
FIG. 3 is an elevated view of a cutting structure brazed in the place within a pocket milled into a rib of the drill bit in accord with FIGS. 1 and 2 of the present invention.

Referring now to FIG. 3 in conjunction with FIGS. 1 and 2, bit body 10 is intended to be rotated in the counter clockwise direction, as viewed in FIG. 2. Thus, each of the ribs 16 has a leading edge surface 16A and a trailing edge surface 16B. As shown in FIG. 3, each of the cutting members 18 is comprised of a mounting body 28 comprised of sintered tungsten carbide or some other suitable material, and a layer 30 of polycrystalline diamond carried on the leading face of the stud 28 and defining the cutting face 30A of the cutting member. The cutting members 18 are mounted in the respective ribs 16 so that their cutting faces are exposed through the leading edge surfaces 16A, respectively. The rib 16 is itself comprised of steel or some other hard metal. The tungsten carbide cutter body 28 is brazed into a pocket 32 (illustrated in FIG. 4) and includes within the pocket the excess braze material 29.

Figure 4:
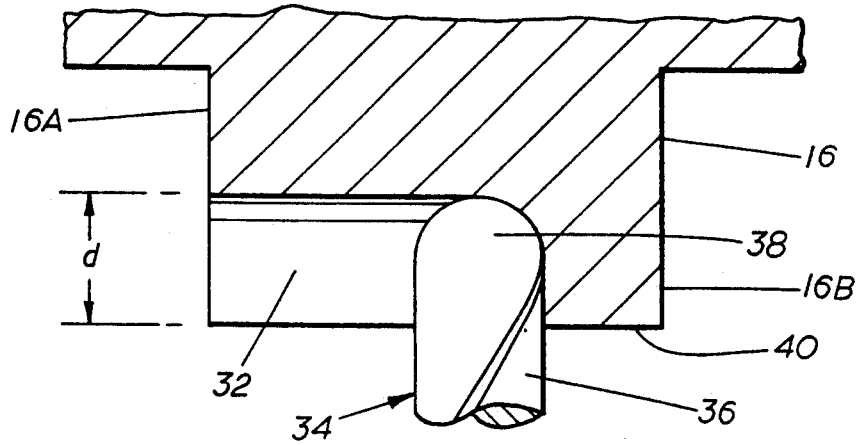
FIG. 4 is an elevated view of a ball nosed end milling tool being used to mill the pocket in the rib illustrated in FIG. 3 in accord with the present invention.

Referring now to FIG. 4, the pocket 32 is milled into the blade 16 through the use of a ball nosed end mill having a shank 36 and a ball (spherical) nosed end 38. In the operation of the ball nosed end mill 34 illustrated in FIG. 4, the pocket 32 is milled into the blade of upset 16 a depth "d" which in the embodiment of FIGS. 3 and 4 exactly matches the diameter of the stud body 28 illustrated in FIG. 3. By using a ball nosed end mill, the pocket also has a spherically shaped end which conforms to the spherical shaped end 42 of the stud 18, as illustrated in FIG. 13. Thus, the cutter assembly 18 is placed within the pocket 32 and is brazed therein by brazing techniques well known to those skilled in the art. The addition of the braze material 29 can be used to have the cutter assembly conform completely to the pocket 32 if desired.

Assuming the depth "d" of the pocket 32 exactly matches the diameter of stud body 28, then is no portion of the cutter extending below the surface 40, thus creating a problem, as those skilled in the art will immediately recognize. While being sound in structure, with the spherical and of the cutter exactly conforming to the end of the pocket, the embodiment of FIG. 3 and 4 can not be used to cut into the rock formations, since the cutter face 30A preferably extends below the surface 40.

Figure 5:
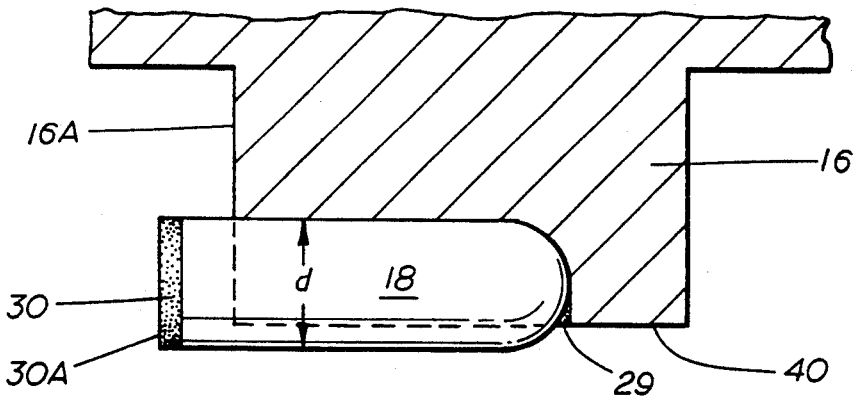
FIG. 5 is an alternative embodiment of the present invention showing a cutting structure brazed into place within a pocket in the rib of a drill bit illustrated in FIGS. 1 and 2 in accord with the present invention.
Figure 6:
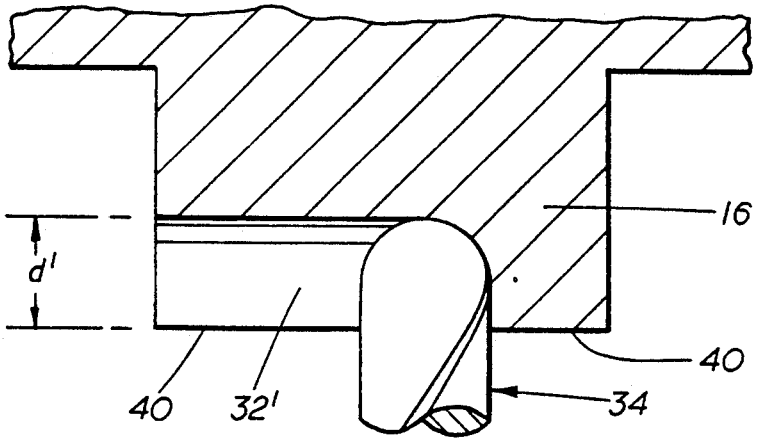
FIG. 6 is an elevated view of an alternative embodiment of a pocket being milled into one of the ribs of the drill bit according to FIGS. 1 and 2 in accord with the present invention.

FIGS. 5 and 6 illustrate a slightly different embodiment in which the ball nosed end mill 34 is used to mill a pocket 32' having a depth d' which is less than the diameter of the stud body 28. Thus, when the cutter assembly 18 is brazed within the pocket 32', the cutter assembly will protrude slightly below the top surface 40 of the blade 16. As was the case with the embodiment shown in FIGS. 3 and 4, the cutter assembly 18 is brazed into the pocket 32' and the additional braze material 29 can be used to make a larger portion of the spherical end of the cutter conform to the pocket if desired. It should be appreciated that in each of the embodiments shown in FIGS. 3–6, the ball nosed end mill allows the pocket 32 or 32' to be milled into the top surface 40 of the upset 16, commencing at the leading edge surface 16A.

Figure 7:
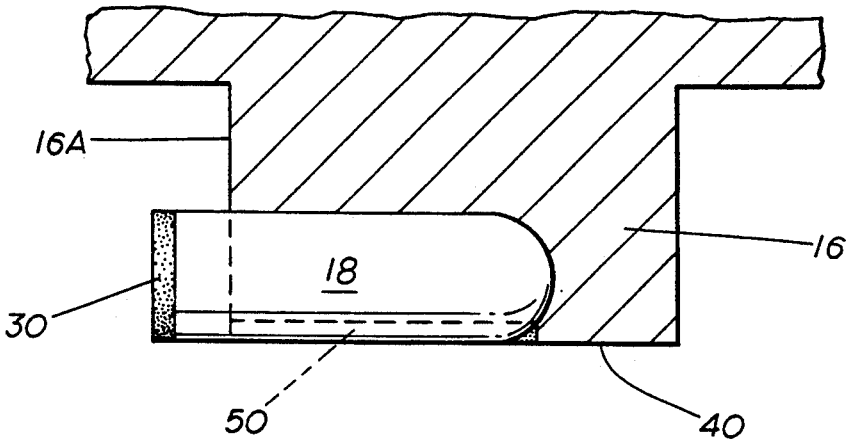
FIG. 7 is an alternative embodiment of a cutting structure brazed into place of a pocket within one of the ribs of the drill bit illustrated in FIGS. 1 and 2 in accord with the present invention.
Figure 8:
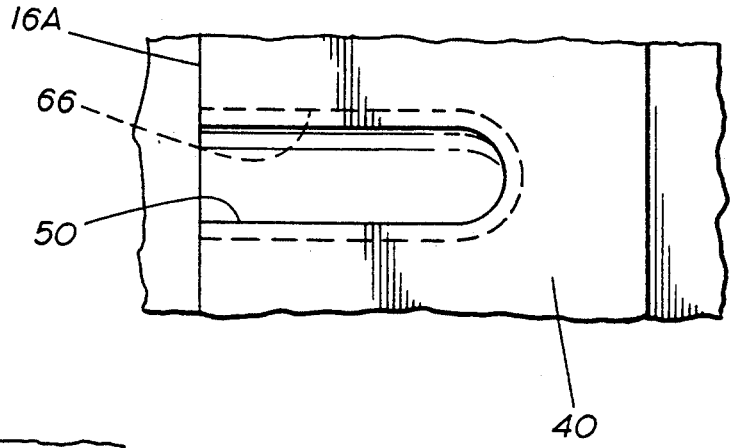
FIG. 8 is a top plan view of a slot milled into the top surface of the rib illustrated in FIG. 7.
Figure 9:
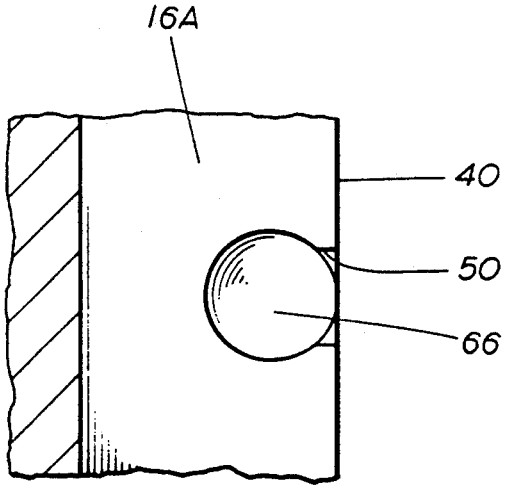
FIG. 9 is an end view of the slot illustrated in FIG. 8.
Figure 10:
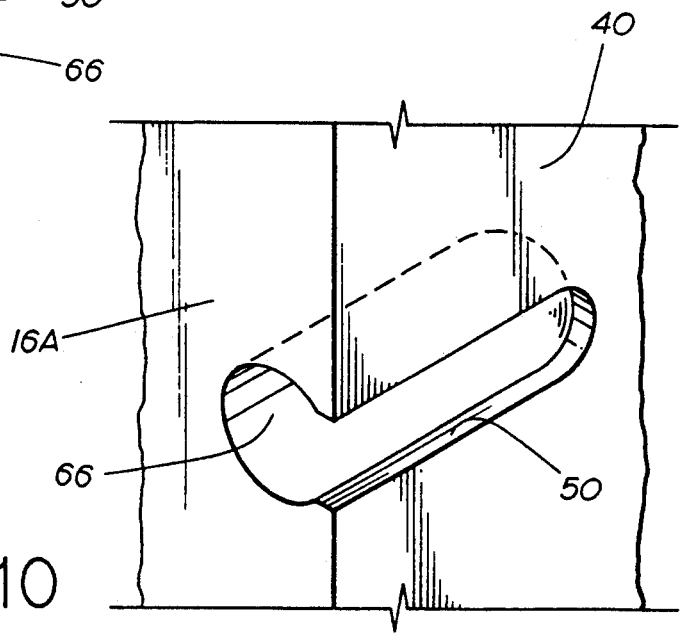
FIG. 10 is a pictorial view of the slot and the pocket milled into the rib illustrated in FIGS. 7-9.

FIGS. 7–10 illustrate an alternative embodiment of the present invention. A first slot 50 is milled into and parallel 20 the top surface 40 having a length which is slightly shorter than the length of the cutting structure 18 and having a width slightly smaller than the diameter of the cylindrical portion 28 of the cutting structure. In the preferred embodiment, the one end of the slot 50 is semi-circular shaped as illustrated in FIG. 8, but the slot can be squared off or have another shape if desired. After the slot 50 is milled into the surface 40, a reduced shank diameter ball nosed end mill 60 (FIG. 12) is used to mill a pocket 66 into the leading face 16A. The shank 62 is reduced in diameter from that of the normal shank diameter illustrated in FIG. 11 and is sized such as to pass through the slot 50 in milling the pocket 66. As was the case with respect to FIGS. 3–6, the end result is a pocket 66 which conforms to the shape of the cutting structure 18 illustrated in FIG. 13.

Thus, whereas the cutting structure 18 is only partially conformed to the spherical end of the pocket 32 or pocket 32' illustrated in FIGS. 5 and 6, the cutting structure 18 is substantially conformed to the spherical end of the pocket 66 illustrated in FIG. 7–10. As is illustrated and described with respect to FIGS. 3–6, the cutter assembly 18 illustrated with respect to FIGS. 7–10 is brazed into the pocket 66.

Figure 15:
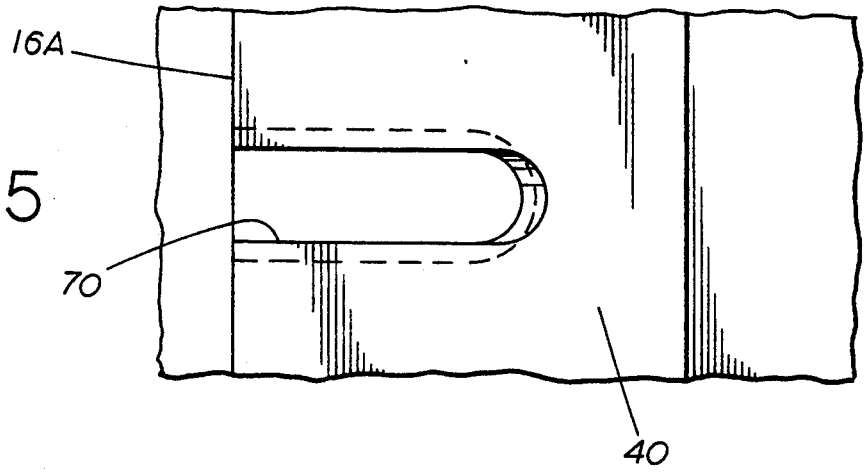
FIG. 15 is a top plan view of the slot milled into the top surface of the rib illustrated in FIG. 14.

However, the embodiment illustrated in FIGS. 7–10 has a problem similar to the problem discussed about with respect to FIGS. 3 and 4, viz., that of the cutter face 30A not extending below the surface 40. FIGS. 14 and 15 illustrate an alternative embodiment which alleviates that problem.

For example, in FIG. 14, instead of milling the slot 70 parallel to the surface 40 (as illustrated in FIG. 7), the slot 70 is milled having a bottom surface 72 commencing at the intersection of surfaces 16A and 40 and angles up to the point 74. FIG. 15 shows a top plan view of the surface 40 having the slot 70 milled therein. The reduced shank end mill illustrated in FIG. 12 is then used to mill out the pocket 76 into which the bullet shaped cutter 18 is brazed, with the spherical end 42 of the cutter conforming to the spherical end of pocket 76. The slot 70 is preferably filled with braze material to fill out the surface 40.

Figure 16:
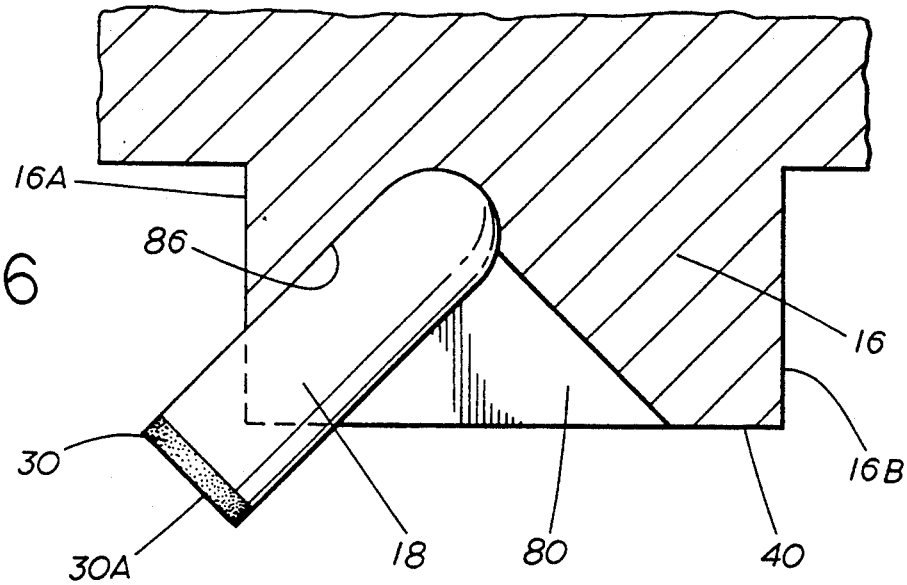
FIG. 16 is an alternative embodiment of a cutter brazed into place within a pocket in a rib of the drill bit illustrated in FIGS. 1 and 2 but having a steeper angle away from the top surface of the rib.
Figure 17:
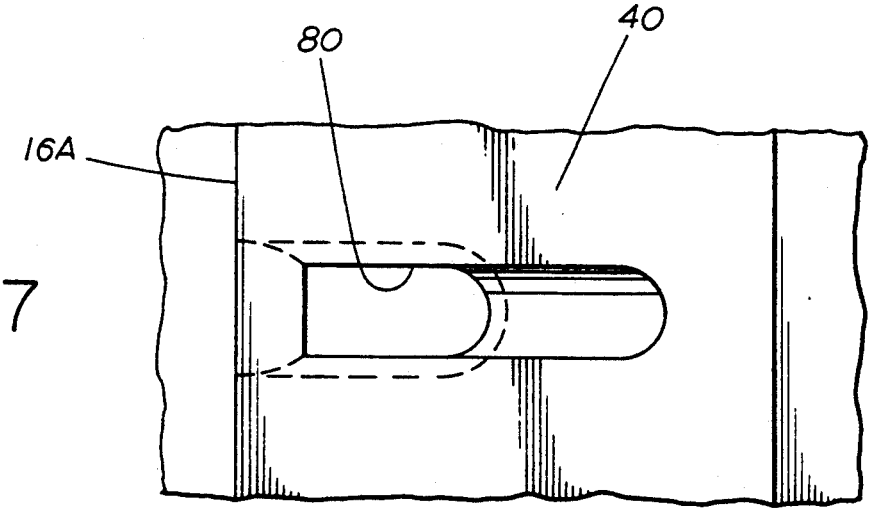
FIG. 17 is a top plan view of the slot milled into the top surface 40 of the embodiment of FIG. 16.

FIG. 16 illustrates a slightly different embodiment in which the slot 80 is milled at an increased angle over that illustrated in FIG. 14 and commences in the surface 40 removed from its intersection with surface 16A. FIG. 17 shows a top plan view of the surface 40 having the slot 80 milled therein. The reduced shank end mill illustrated in FIG. 12 is then used to mill out the pocket 86, into which the cutter 18 is brazed. The slot 80 is filled with braze material.

It should be appreciated that in both of the embodiments of FIGS. 14 and 16, the cutting face 30A extends below the surface 40.

Figure 18:
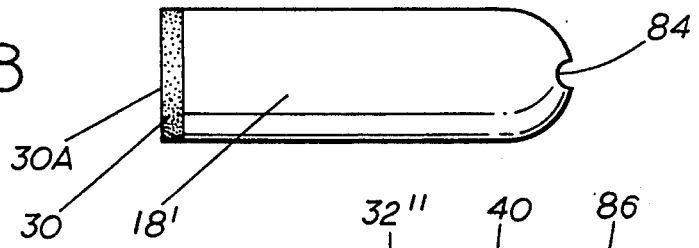
FIG. 18 is a pictorial representation of an alternative embodiment of the cutter assembly having a receptacle at its spherical shaped end to receive a pin illustrated in FIG. 20.
Figure 20:
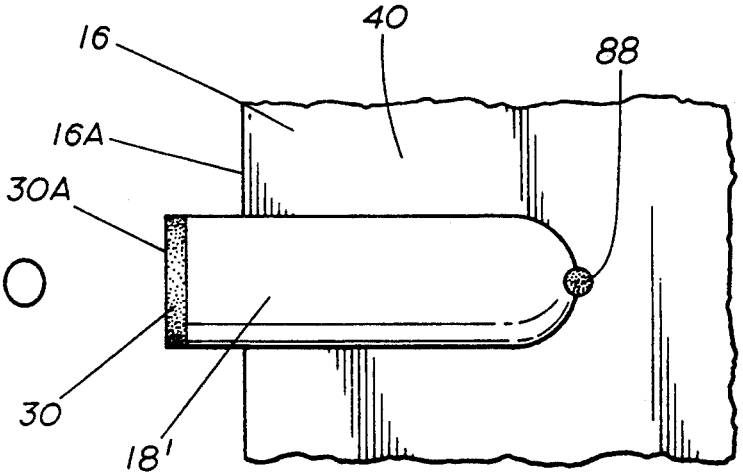
FIG. 20 is a top plan view of the cutter assembly illustrated in FIG. 18 brazed into place within the pocket illustrated in FIG. 19 and having a pin brazed therein to anchor the cutter assembly into the pocket.
Figure 21:
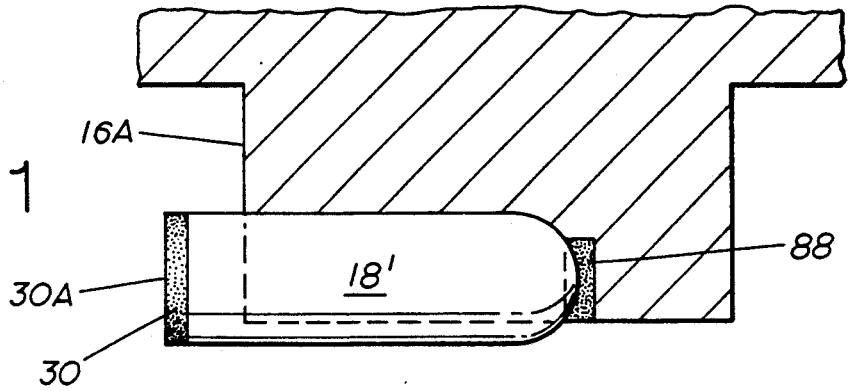
FIG. 21 is an elevated view of the cutter assembly of FIG. 18 brazed into place within the pocket illustrated in FIG. 19 and having the pin brazed therein to anchor the cutter assembly into the pocket.

Referring now to FIG. 18, a second embodiment of the bullet-shaped cutter 18' is illustrated as having a semi-circular receptacle 84 which is configured to receive the pin 88 illustrated in FIG. 20.

Figure 19:
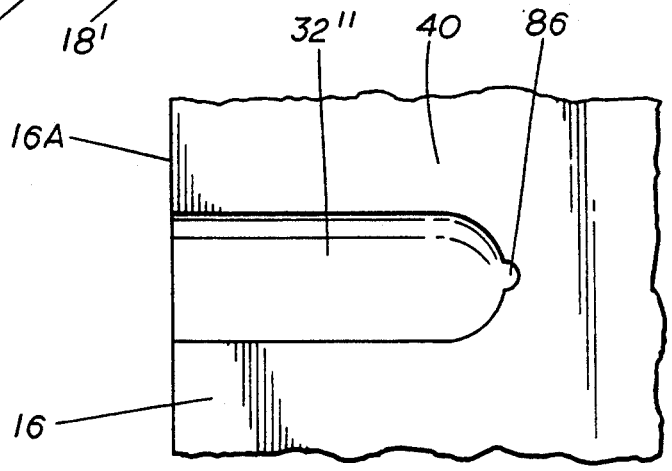
FIG. 19 is a pictorial representation of a pocket having a receptacle at its spherical shaped end to also receive the pin illustrated in FIG. 20.

FIG. 19 illustrates a different embodiment of the pocket 32" shown as having a semicircular receptacle 86 configured into the spherical end of the pocket 32".

FIG. 20 shows an elevated view of the cutter 18' brazed into place in the pocket 32" and also having the pin 88 brazed into place to anchor the cutter 18' within the pocket 32".

It should be appreciated that the cutter and pocket assembly illustrated in FIGS. 18–21 is intended to remedy a potential problem associated with the embodiment of FIG. 5. In viewing the embodiment of FIG. 5, it will be immediately recognized that as the cutter face 30A cuts into the earth's formations, there will be a tendency for the cutter 18 to be pushed out of the pocket 32' illustrated in FIG. 6. By brazing the pin 88 of FIG. 21 into the matching receptacles 84 and 86 during the assembly process, the cutter 18' will be anchored into the pocket 32" to prevent the cutter from being pushed up out of the pocket.

The receptacles 84 and 86 and the pin 88 can also be used to provide orientation of the cutter 18' in the pocket 32" such as, for example, whenever the cutter 18' has one of its sides flattened, either intentionally or unintentionally, or in the case of the cutter face 30 having a specific orientation such as, for example, whenever CLAW cutters are used in bits manufactured by DB Stratabit, Inc., a sister company of Baroid Technology, Inc., the Assignee of this present application. When the cutter is flat on one side, essentially being a truncated cylindrical body except for its spherical end, the pocket for receiving the cutter will have a flat bottom to match the flat on the cutter, and will thus have a truncated semi-circular second end.

Figure 22:
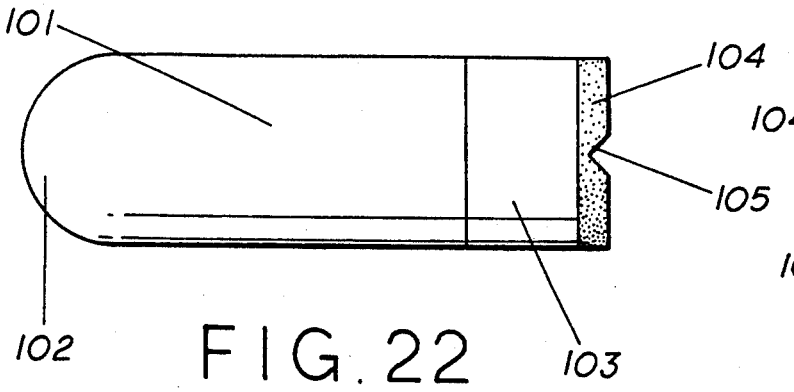
FIG. 22 is a pictorial view of a bullet-shaped cutter in accord with the present invention having an alternative embodiment of the invention, including a non-planar cutter face.
Figure 23:
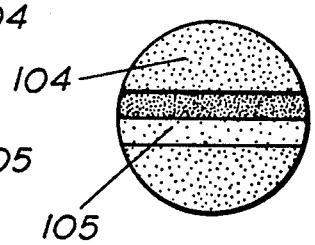
FIG. 23 is an end view of the cutter illustrated in FIG. 22.

Referring now to FIG. 22, there is illustrated a bullet-shaped cutter 101 having a spherical end 102 and a cutter assembly 103 and 104 which comprises a carrier body 103 of tungsten carbide and a PDC cutter face 104 which has a V-shaped groove 105 across its face. The groove may have its median length (the apex of the groove) on the diameter of the cutter face, or may be on another chord if desired.

Figure 24:
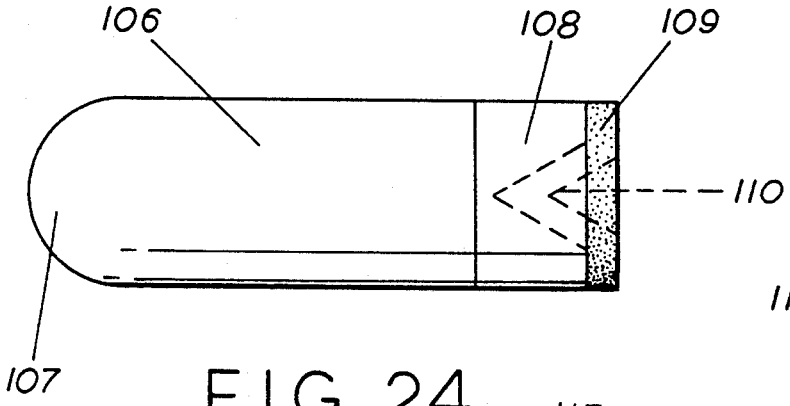
FIG. 24 is an alternative embodiment of the present invention having an alternative, non-planar cutter face.
Figure 25:
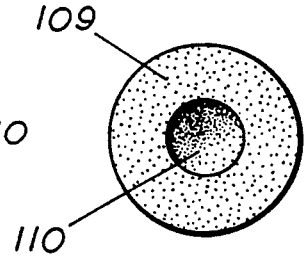
FIG. 25 is an end view of the cutter illustrated in FIG. 24.

FIG. 24 illustrates another bullet-shaped cutter assembly 106 having a spherical first end 107. Its other end has a tungsten carbide carrier 108 and a PDC cutter face 109 having therein a conical-shaped orifice 110.

Figure 26:
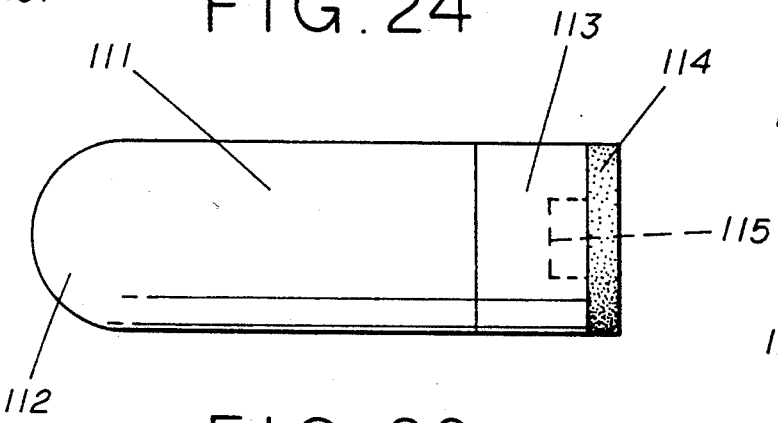
FIG. 26 is an alternative embodiment of the present invention showing an alternative, non-planar cutter face.
Figure 27:
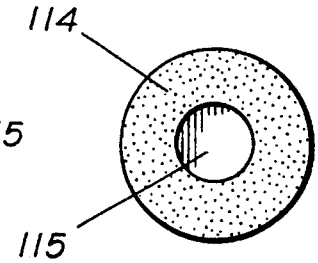
FIG. 27 is an end view of the cutter illustrated in FIG. 26.

FIG. 26 illustrates yet another bullet-shaped cutter assembly 111 having a spherical first end 112 and at its other end a tungsten carbide carrier 113 and a PDC cutter face 114. A center hole 115 extends through the cutter face 114 and also extends into the tungsten carbide carrier 113.

Figure 28:
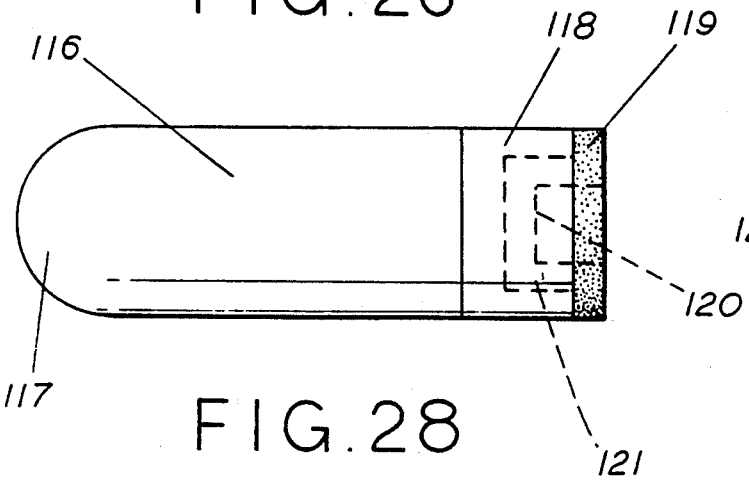
FIG. 28 is an alternative embodiment of the present invention showing an alternative, non-planar cutter face.
Figure 29:
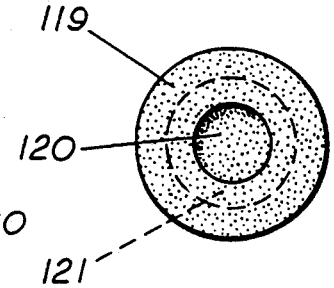
FIG. 29 is an end view of the cutter illustrated in FIG. 28.

FIG. 28 illustrates yet another bullet-shaped cutter assembly 116 having a spherical first end 117 and having at its second end a tungsten carbide carrier 118 and a PDC cutter face 119. A center hole 120 extends completely through the PDC cutter face 119 and also extends into the tungsten carbide carrier 118. A layer of PDC material 121 surrounds the center hole 120.

FIG. 30 illustrates the utility of the chip-breaker cutter assemblies illustrated in FIGS. 22–29. For example, the cutter assembly 101 illustrated in FIG. 22 is brazed into a pocket in a rib 16 in the same manner as was illustrated in FIG. 5. As the cutter assembly 101 cuts into the earth formation 125, it is common practice that small slivers or chips 126 are generated. Since it is desirable to break the chips off, the cutter face 104 having the V-shaped indentation 105 causes the chip 126 to break off. In a similar manner, the embodiments illustrated in FIGS. 22–29 will cause the chips from the formation to enter the orifices 110, 115 or 120 and thus be broken off.

FIG. 31 illustrates a cutter assembly, for example the cutter assembly 106 illustrated in FIG. 24, which demonstrates that the chip breaker cutter faces and their underlying tungsten carbide carriers can be mounted on a conventional stud assembly as an alternative to the embodiments illustrated herein before in which they are mounted on the bullet-shaped cutter assemblies.

FIG. 32 illustrates an alternative embodiment of the present invention in which each of the stabilizer ribs or kickers 20 of FIGS. 1 and 2 is modified to include a tungsten carbide button or insert 132 above the gauge cutter assembly 134. The tungsten carbide button is at the gauge diameter and is positioned to be at exactly the same diameter as the cutting face 134A. It should be appreciated that each of the stabilizers 20 has such a tungsten carbide button 132 placed thereon at the gauge diameter.

As a conventional PDC drill bit rotates, it tends to dig into the side of the borehole. This phenomenon reinforces itself on subsequent passes of the bit. Progressively, a non-uniformity is generated in the borehole wall, causing an impact on the gauge cutter in response to the wobble of the bit. Thus, because PDC bits tend to make the borehole slightly larger than the gage diameter of the bit, often times causing the bit to wobble as it rotates, the stabilizer ribs 20 are otherwise exposed to high impact forces which can also damage the cutter assemblies such as the cutter assembly 134. To minimize this impact upon the cutter assemblies and the bit, the tungsten carbide button, being at the gage diameter, protrudes laterally just ahead of the outer cutting elements. The protrusion takes the impact, instead of the cutter, and thus protects the cutter structure. The button 132 can be manufactured from tungsten carbide or any other hard metal material, or it can be steel coated with another hard material or the like. The present invention overcomes this problem by positioning the tungsten carbide insert on the stabilizer rib to take the impact which would have otherwise been inflicted on the cutter assembly.

We claim:

1. A drag bit for drilling oil and gas wells, comprising:

a hard metal body having an end face, said end face defining a plurality of upsets each having a top surface and a leading edge surface, at least one of said top surfaces having at least one pocket milled therein, said at least one pocket having a semi-spherical first end and a second end intersecting said leading edge surface, the shape in cross-section of said second end being semi-circular at the intersection of said second end of said pocket with said leading edge surface; and a cutting structure brazed into said at least one pocket, said cutting structure having a spherical first end at least partially conforming to the said first end of said pocket and a second end defining a polychrystalline diamond compact cutting face.

2. The drag bit according to claim 1, wherein each of said top surfaces of said plurality of upsets has at least one of said pockets milled therein.

3. The drag bit according to claim 2, wherein each of said pockets has one of said cutting structures brazed therein.

4. The drag bit according to claim 1, wherein each of said top surfaces of said plurality of upsets has a plurality of said pockets milled therein.

5. The drag bit according to claim 4, wherein each of said pockets has one of said cutting structures brazed therein.

6. A drag bit for drilling oil and gas wells, comprising:

a hard metal body having an end face, said end face defining a plurality of upsets each having a top surface and a leading edge surface, at least one of said top surfaces having at least one slot milled therein, said at least one slot having first and second ends, said second end intersecting said leading edge surface, the upset having said at least one slot also having at least one pocket milled therein, said at least one pocket having a spherical first end and a second end intersecting said leading edge surface, the shape in cross-section of said second end being semi-circular at the intersection of said second end of said pocket with said leading edge surface, said at least one slot being contiguous to said at least one pocket; and a cutting structure brazed into said at least one pocket, said cutting structure having a spherical first end conforming to the said first end of said pocket and a second end defining a polycrystalline diamond cutting face.

7. The drag bit according to claim 6, wherein said each of said at least one slots has a semi-circular first end.

8. The drag bit according to claim 6, wherein each of said top surfaces of said plurality of upsets has at least one of said slots milled therein and one of said pockets milled contiguous to tone of said slots, respectively.

9. The drag bit according to claim 8, wherein each of said top surfaces of said plurality of upsets has a plurality of said slots milled therein, and each of said upsets also has a plurality of said pockets milled therein, each of said slots having a pocket milled contiguous thereto.

10. The drag bit according to claim 9, wherein each of said pockets has one of said cutting structures brazed therein.

11. A cutting structure for a drag bit, comprising:

a tungsten carbide, cylindrically-shaped center portion having a spherical first end and a second end defining a polycrystalline diamond compact cutting surface, said cutting surface being in a plane orthogonal to the longitudinal axis of said cutting structure.

12. The cutter structure according to claim 11, including in addition thereto, a semi-circular receptacle in said spherical end for receiving a cylindrical-shaped anchor pin.

13. A drag bit for drilling oil and gas wells, comprising:

a hard metal body having an end face, said end face defining a plurality of upsets each having a top surface and a leading edge surface, at least one of said top surfaces having at least one pocket milled therein, said at least one pocket having a semi-spherical first end and a second end intersecting said leading edge surface, the shape in cross-section of said second end being semi-circular at the intersection of said second end of said pocket with said leading edge surface, said semi-spherical first end of said pocket having a first semi-circular receptacle therein;

a cutting structure brazed into said at least one pocket, said cutting structure having a spherical first end at least partially conforming to the said first end of said pocket and a second end defining a polycrystalline diamond compact cutting face, said semi-spherical end of said cutting structure having a second semi-circular receptacle therein; and a pin brazed into said first and second receptacles.

14. A drag bit for drilling oil and gas wells, comprising:

a hard metal body having an end face, said end face defining a plurality of upsets each having a top surface and a leading edge surface, at least one of said top surfaces having at least one pocket milled therein, said at least one pocket having a semi-spherical first end and a second end intersecting said leading edge surface, the shape in cross-section of said second end being semi-circular at the intersection of said second end of said pocket with said leading edge surface, said semi-spherical first end of said pocket having a first receptacle therein;

a cutting structure brazed into said at least one pocket, said cutting structure having a spherical first end at least partially conforming to the said first end of said pocket and a second end defining a polycrystalline diamond compact cutting face, said semi-spherical end of said cutting structure having a second receptacle therein; and a pin brazed into said first and second receptacles.

15. The drag bit according to claim 14, wherein each of said top surfaces of said plurality of upsets has at least one of said pockets milled therein.

16. The drag bit according to claim 15, wherein each of said pockets has one of said cutting structures brazed therein.

17. The drag bit according to claim 14, wherein each of said top surfaces of said plurality of upsets has a plurality of said pockets milled therein.

18. The drag bit according to claim 17, wherein each of said pockets has one of said cutting structures brazed therein.

19. A drag bit for drilling oil and gas wells, comprising:

a hard metal body having an end face, said end face defining a plurality of upsets each having a top surface and a leading edge surface, at least one of said top surfaces having at least one pocket milled therein, said at least one pocket having a semi-spherical first end and a second end intersecting said leading edge surface, the shape in cross-section of said second end being truncated, semi-circular at the intersection of said second end with said leading edge surfaces, and a cutting structure brazed into said at least one pocket, said cutting structure having a spherical first end at least partially conforming to the said first end of said pocket, a second end defining a polycrystalline diamond compact cutting face, and a cylindrical portion between said first and second ends.

20. The drag bit according to claim 19, wherein each of said top surfaces of said plurality of upsets has at least one of said pockets milled therein.

21. The drag bit according to claim 20, wherein each of said pockets has one of said cutting structures brazed therein.

22. The drag bit according to claim 19, wherein each of said top surfaces of said plurality of upsets has a plurality of said pockets milled therein.

23. The drag bit according to claim 22, wherein each of said pockets has one of said cutting structures brazed therein.

24. A drag bit for drilling oil and gas wells, comprising:

a hard metal body having an end face, said end face defining a plurality of upsets each having a top surface and a leading surface, at least one of said top surfaces having at least one slot milled therein, said at least one slot having first and second ends, said second end intersecting said leading edge surface, said upset having said at least one slot also having at least one pocket milled therein, said at least one pocket having a spherical first end and a second end, the shape in cross-section of said second end being truncated, semi-circular at the intersection of said second end with said leading edge surface, said at least one slot being contiguous to said at least one pocket; and a cutting structure brazed into said at least one pocket, said cutting structure having a spherical first end conforming to the said first ends of said pocket, a second end defining a polycrystalline diamond cutting face, and a cylindrical portion between said first and second ends.

25. The drag bit according to claim 24, wherein said each of said at least one slots has a semi-circular first end.

26. the drag bit according to claim 24, wherein each of said top surfaces of said plurality of upsets has at least one of said slots milled therein and one of said pockets milled contiguous to one of said slots, respectively.

27. The drag bit according to claim 26, wherein each of said top surfaces of said plurality of upsets has a plurality of said slots milled therein, and each of said upsets also has a plurality of said pockets milled therein, each of said slots having a pocket milled contiguous thereto.

28. The drag bit according to claim 27, wherein each of said pockets has one of said cutting structures brazed therein.

* * * * *

UNITED STATES PATENT AND TRADEMARK OFFICE
CERTIFICATE OF CORRECTION

PATENT NO. : 5,333,699

DATED : August 2, 1994

INVENTOR(S) : Gary M. Thigpen and William H. Sherwood

It is certified that error appears in the above-identified patent and that said Letters Patent is hereby corrected as shown below:

In Column 8, Line 47, delete "tone" and insert therefor --one--.

In Column 10, Line 42, delete "ends" and insert therefor --end--.

Signed and Sealed this

Twenty-fifth Day of October, 1994

*Attest:*

Bruce Lehman

BRUCE LEHMAN

*Attesting Officer*

*Commissioner of Patents and Trademarks*